US011713947B2

(12) United States Patent
Calka

(10) Patent No.: US 11,713,947 B2
(45) Date of Patent: Aug. 1, 2023

(54) SYSTEM AND METHOD OF OPERATING A CONDUCTED ELECTRICAL DEVICE

(71) Applicant: MOTOROLA SOLUTIONS, INC., Chicago, IL (US)

(72) Inventor: Pawel Calka, Cracow (PL)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 291 days.

(21) Appl. No.: 16/616,657

(22) PCT Filed: Jun. 2, 2017

(86) PCT No.: PCT/PL2017/050032
§ 371 (c)(1),
(2) Date: Nov. 25, 2019

(87) PCT Pub. No.: WO2018/222058
PCT Pub. Date: Dec. 6, 2018

(65) Prior Publication Data

US 2020/0173757 A1 Jun. 4, 2020

(51) Int. Cl.
*F41H 13/00* (2006.01)

(52) U.S. Cl.
CPC ..... *F41H 13/0025* (2013.01)

(58) Field of Classification Search
CPC ..... H02H 1/063; H02H 9/046; H02J 7/0014
USPC ..... 361/56
See application file for complete search history.

(56) References Cited

U.S. PATENT DOCUMENTS

| | | | | |
|---|---|---|---|---|
| 5,654,867 | A * | 8/1997 | Murray | F41H 13/0025 361/232 |
| 6,898,887 | B1 | 5/2005 | Stratbucker | |
| 7,921,588 | B2 | 4/2011 | Brown et al. | |
| 10,288,388 | B1 * | 5/2019 | Lavin | F41H 13/0025 |
| 2008/0137260 | A2 * | 6/2008 | Brundula | H05C 1/06 361/232 |
| 2009/0020002 | A1 * | 1/2009 | Williams | F41H 13/0031 89/41.03 |
| 2013/0016449 | A1 | 1/2013 | Crandall | |
| 2014/0334058 | A1 | 11/2014 | Galvan et al. | |
| 2015/0153144 | A1 * | 6/2015 | Cheatham, III | A61N 1/3987 607/7 |

(Continued)

FOREIGN PATENT DOCUMENTS

| | | | |
|---|---|---|---|
| DE | 19952437 | A1 | 5/2001 |
| WO | 2008/097377 | A2 | 8/2008 |
| WO | 2013/053033 | A1 | 4/2013 |

OTHER PUBLICATIONS

International Preliminary Report on Patentability as dated Dec. 12, 2019 for International Application No. PCT/PL2017/050032.

(Continued)

*Primary Examiner* — Thienvu V Tran
*Assistant Examiner* — Sreeya Sreevatsa
(74) *Attorney, Agent, or Firm* — Michael Best & Friedrich LLP

(57) ABSTRACT

A conducted electrical device (100) that includes a housing (120), an electrode (105) configured to be ejected from the housing (120), and a controller (205). The controller (205) is configured to receive a characteristic as a function of at least one selected from the group consisting of audio and video, corresponding to a target (110), and control the electrode (105) based on the characteristic.

24 Claims, 6 Drawing Sheets

(56) References Cited

U.S. PATENT DOCUMENTS

2017/0364349 A1* 12/2017 Conant ..... G06F 8/60

OTHER PUBLICATIONS

International Search Report and Written Opinion dated Jan. 31, 2017 for International Application No. PCT/PL2017/050032 (15 pages).

* cited by examiner

SYSTEM AND METHOD OF OPERATING A CONDUCTED ELECTRICAL DEVICE

BACKGROUND OF THE INVENTION

Conducted electrical devices, such as TASERS, project one or more electrodes toward a target. The electrodes make contact with the target and deliver an electric current to the target in order to subdue the target in a non-lethal manner.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
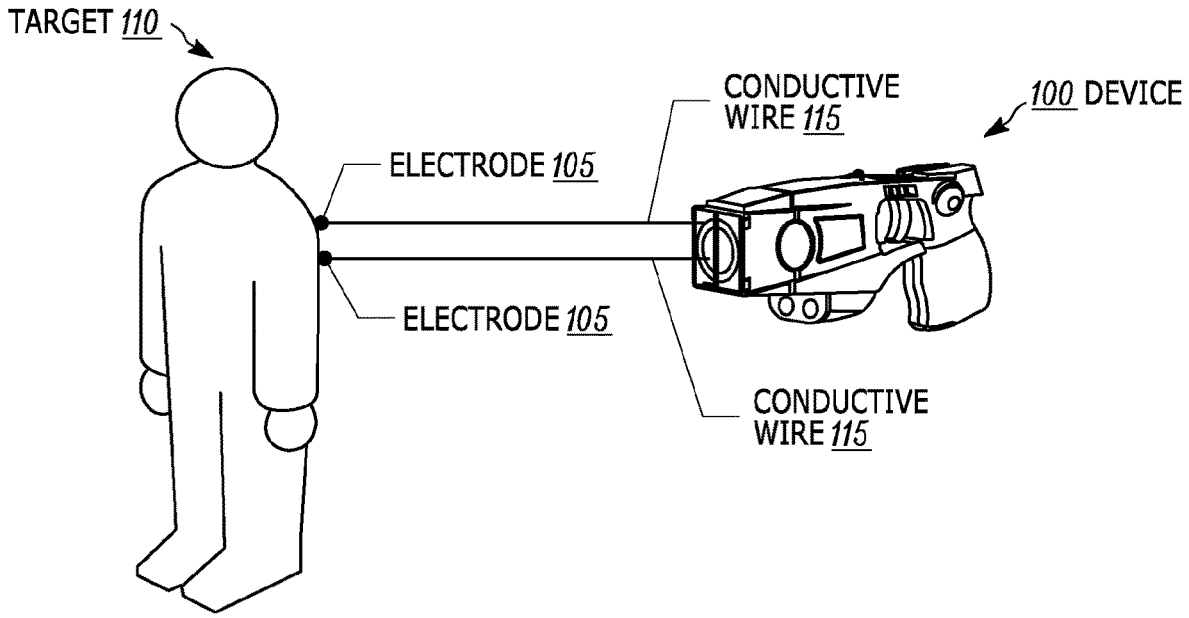
FIG. 1 is a perspective view of a device and a target according to some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Conducted electrical devices are capable of incapacitating a person and causing pain to that person through the application of an electric current. Conducted electrical devices have been used by law enforcement to temporarily incapacitate a violent or combative suspect during an arrest. One of the advantages of conducted electrical devices that a suspect can be incapacitated without application of lethal force or by using a lethal weapon, such as a gun. However, conducted electrical devices can cause injury. The severity of potential injury if the current can be adjusted to a point that still causes incapacitation but has been adjusted based on particular characteristics of the target person.

One embodiment provides a conducted electrical device that includes a housing, an electrode configured to be ejected from the housing, and a controller. The controller is configured to receive a characteristic as a function of at least one selected from the group consisting of audio and video, corresponding to a target, and control the electrode based on the characteristic.

Another embodiment provides a method of controlling a conducted electrical device that includes a housing and an electrode configured to be projected from the housing. The method includes receiving, via a sensor, a characteristic of a target, wherein the sensor is at least one selected from the group consisting of an audio sensor and a video sensor. The method further includes controlling, via a controller, the electrode based on the characteristic.

Yet another embodiments provides a system that includes a first device and a second device. The second device includes a housing, an electrode configured to be projected from the housing, and a controller. The controller is configured to receive, from the first device, a characteristic as a function of at least one selected from the group consisting of audio and video, corresponding to a target, and control the electrode based on the characteristic.

FIG. 1 illustrates an electrical conducted device 100 according to some embodiments. The device 100 is configured to project one or more electrodes 105 toward a target 110. Once in contact with the target 110, the electrodes 105 are configured to deliver an electrical current to the target 110. In some embodiments, the electrodes 105 are electrically connected to the device 100, and the current is delivered, via conductive wires 115.

Figure 2:
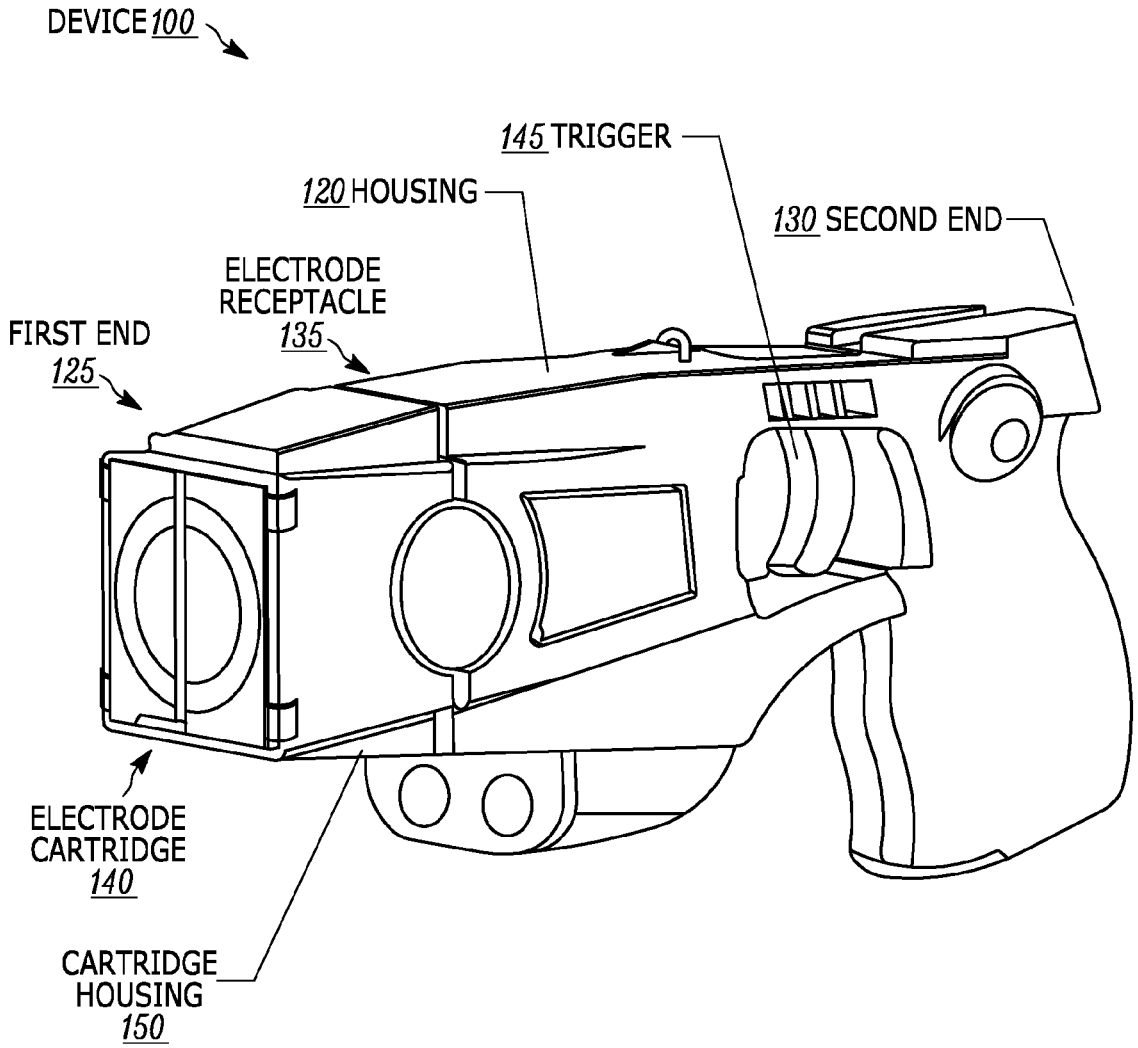
FIG. 2 is a perspective view of the device of FIG. 1 according to some embodiments.

FIG. 2 illustrates a perspective view of the device 100 according to some embodiments. In the example shown, the device 100 includes a housing 120 formed of plastic or another non-conductive material. The housing 120 includes a first end 125 and a second end 130, opposite the first end 125. The first end 125 may include an electrode receptacle 135. As illustrated, the electrode receptacle 135 may be configured to receive an electrode cartridge 140. The device 100 also includes a trigger 145. In the illustrated embodiment, the trigger 145 is located proximate the second end 130.

Figure 3:
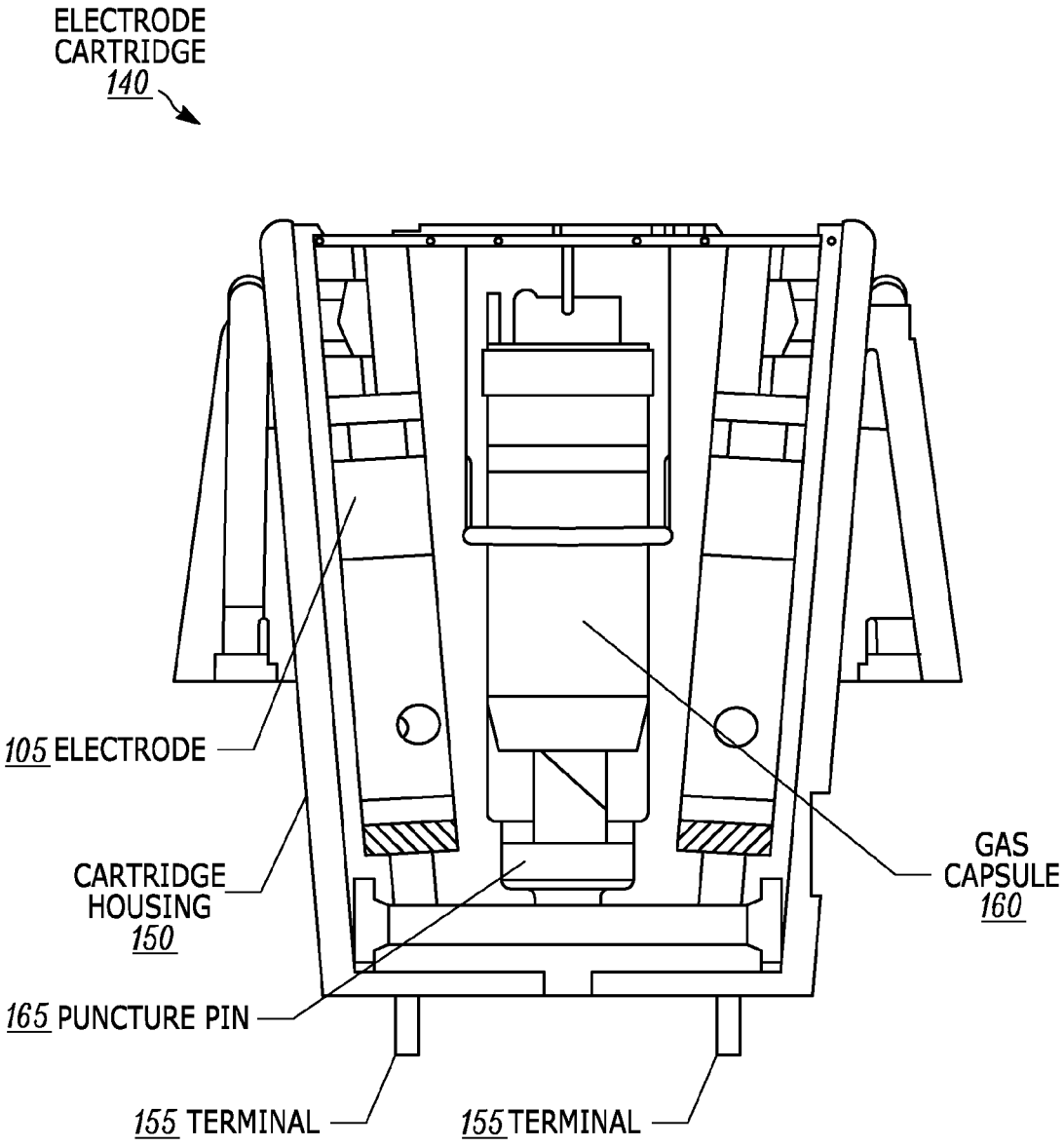
FIG. 3 is a cutaway view of an electrode cartridge of the device of FIG. 1 according to some embodiments.

FIG. 3 illustrates a cutaway side view of the electrode cartridge 140. In some embodiments, the electrode cartridge 140 is a single use cartridge configured to be replaced after use. In other embodiments, the electrode cartridge 140 is a multiple use cartridge. The electrode cartridge 140 includes a cartridge housing 150, which may contain one or more electrical and/or communicative terminals 155, a gas capsule 160, a puncture pin 165, and the one or more electrodes 105.

The electrode cartridge 140 is electrically and/or communicatively connected to the device 100 via the electrical and/or communicative terminals 155. When a trigger signal is sent from the device 100 to the electrode cartridge 140, the puncture pin 165 punctures the gas capsule 160, releasing a pressurized gas to project the one or more electrodes 105 from the electrode cartridge 140 toward the target 110.

Figure 4:
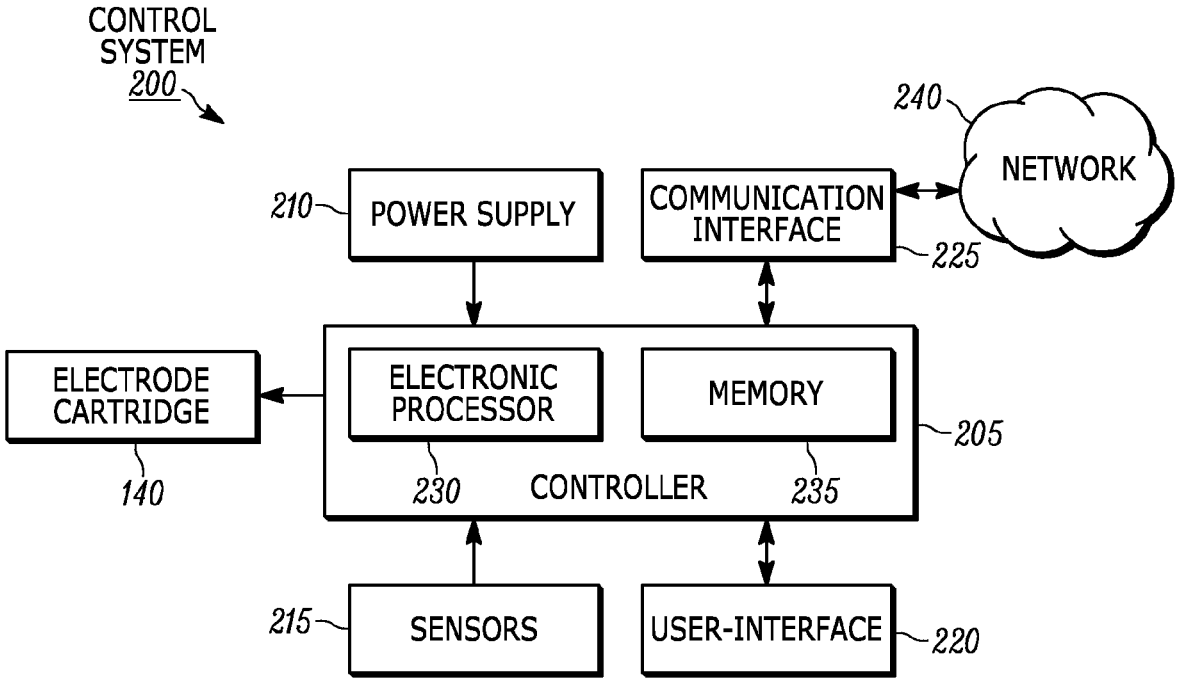
FIG. 4 is a block diagram of a control system of the device of FIG. 1 according to some embodiments.

FIG. 4 illustrates a block diagram of a control system 200 of the device 100. The control system 200 includes a controller 205. The controller 205 is electrically and/or communicatively connected to a variety of modules or components of the device 100. For example, the controller 205 is connected to the electrode cartridge 140 (via the electrical and/or communicative terminals 155), a power supply 210, one or more sensors 215, a user-interface 220, and a communication interface 225.

In some embodiments, the controller 205 includes a plurality of electrical and electronic components that provide power, operational control, and protection to the components and modules within the controller 205 and/or the device 100. For example, the controller 205 includes, among other things, an electronic processor 230 (for example, a microprocessor or another suitable programmable device) and the memory 235.

The memory 235 includes, for example, a program storage area and a data storage area. The program storage area and the data storage area can include combinations of different types of memory, such as read-only memory (ROM), random access memory (RAM). Various non-transitory computer readable media, for example, magnetic, optical, physical, or electronic memory may be used. The electronic processor 230 is communicatively coupled to the memory 235 and executes software instructions that are stored in the memory 235, or stored on another non-transitory computer readable medium such as another memory or a disc. The software may include one or more applications, program data, filters, rules, one or more program modules, and other executable instructions.

The power supply 210 is configured to supply power to the device 100. In some embodiments, the power supply 210 is a battery, such as a rechargeable battery, or other suitable power source. The power supply 210 is configured to supply the current to the electrodes 105. Additionally, the power supply 210 supplies a nominal voltage to the controller 205 and other components of the device 100.

The one or more sensors 215 are configured to sense one or more characteristics of the device 100, the target 110, an area surrounding the device 100, and/or an area surrounding the target 110. The one or more sensors 215 may include, but are not limited to, a camera (for example, a video camera, an infrared camera, retinal scanner, etc.), an audio sensor (for example, a microphone, a transducer, etc.), an explosive device sensor, a heartbeat sensor, and current and/or voltage sensor. In some embodiments, the sensors 215 provide information to electronic processor 230 which uses software stored in the memory 235 (for example, facial recognition software, object detection software, biometric analysis software, and other programs) to determine one or more characteristics of the target. In another embodiment, the sensors 215 provide information to server 410 (FIG. 5) which uses software stored on the server 410 (FIG. 5) (for example, facial recognition software, object detection software, biometric analysis software, and other programs) to determine one or more characteristics of the target. In some embodiments, server 410 (FIG. 5) may receive information from other devices (for example, a camera, a personal area network (PAN), sensor external from device 100, or other remote servers) to determine one or more characteristics of the target. One or more characteristics sensed by or determined at least in part based on information from the sensors 215 may include, but are not limited to, one or more parameters of the target 110 (for example, sex, height, weight, blood pressure, heart rate, blood alcohol level, drug use, heart disease, mental illness, type of clothing worn, etc.), one or more conditions of the target 110 (for example, is the target 110 screaming, is the target 110 running, is the target 110 nervous, is the target 110 handcuffed or otherwise incapacitated, is the target 110 under the influence of the device 100 or other device 400 (FIG. 5), etc.), conditions of area surrounding the device 100 and/or the target 110 (for example, rain, snow, explosive material present, etc.), characteristics of the device 100 (for example, current direction of aim of the device 100, if the device 100 has recently been used on target 110, etc.).

In some embodiments, the sensors 215 may be located within the electrodes 105 or conductive wires 115. For example, the electrodes 105, once connected to the target 110, may be used to sense one or more characteristics of the target 110. In some embodiments, the sensors 215 may be located within the housing 120. In other embodiments, the sensors 215 may be located remotely from the device 100 (for example, in an additional device 400 (FIG. 5) and/or a portable device 405 (FIG. 5)).

The user-interface 220 is communicatively coupled to the controller 205. The user-interface 220 is used to receive user input and/or provide user output. The user-interface 220 includes one or more input devices and one or more output devices. The input devices include, for example, touch-screen displays, a plurality of knobs, dials, switches, and/or buttons. The output devices include, for example, speakers and/or a display (far example, a primary display, a second display).

The communication interface 225 provides a communication link between the device 100 and a network 240. In some embodiments, the network 240 is, for example, a wide area network (WAN) (e.g., the Internet, a TCP/IP based network, a cellular network, such as, for example, a Global System for Mobile Communications [GSM] network, a General Packet Radio Service [GPRS] network, a Code Division Multiple Access [CDMA] network, an Evolution-Data Optimized [EV-DO] network, an Enhanced Data Rates for GSM Evolution [EDGE] network, a 3GSM network, a 4GSM network, a Digital Enhanced Cordless Telecommunications [DECT] network, a Digital AMPS [IS-136/TDMA] network, or an Integrated Digital Enhanced Network [iDEN] network, etc.). In other embodiments, the network is, for example, a local area network (LAN), a neighborhood area network (NAN), a home area network (HAN), or personal area network (PAN) employing any of a variety of communications protocols, such as Wi-Fi, Bluetooth, ZigBee, etc. In yet another embodiment, the network 240 includes one or more of a wide area network (WAN), a local area network (LAN), a neighborhood area network (NAN), a home area network (HAN), or personal area network (PAN).

Communications through the network 240 can be protected using one or more encryption techniques, such as those techniques provided in the Institute of Electrical and Electronic Engineers (IEEE) 802.1 (www.ieee802.org/1/) standard for port-based network security, pre-shared key, Extensible Authentication Protocol (EAP), Wired Equivalency Privacy (WEP), Temporal Key Integrity Protocol (TKIP), Wi-Fi Protected Access (WPA), and the like. The connections between the communication interface 225 and the network 240 are, for example, wired connections, wireless connections, or a combination of wireless and wired connections. In some embodiments, the device 100 or the communication interface 225 include one or more communications ports (e.g., Ethernet, serial advanced technology attachment (SATA), universal serial bus (USB), integrated drive electronics (IDE), and the like) for transferring, receiving, or storing data associated with the device 100.

Figure 5:
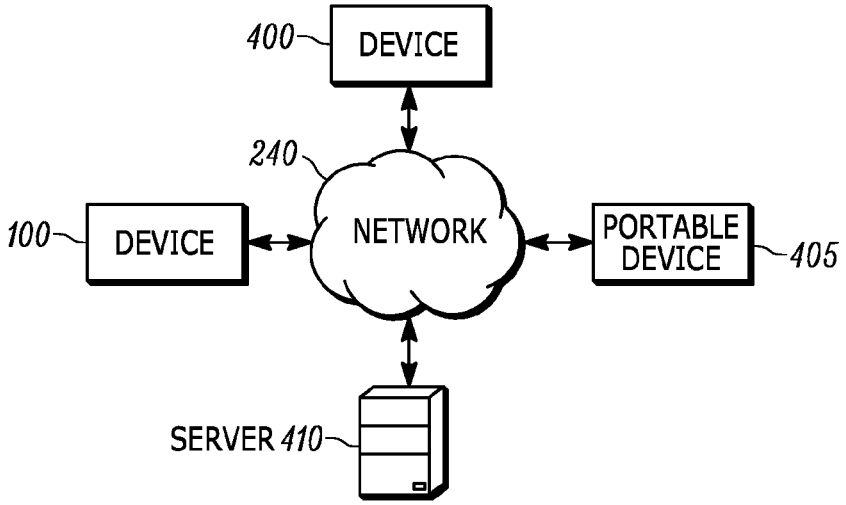
FIG. 5 is a block diagram of a network used in conjunction with the device of FIG. 1 according to some embodiments.

FIG. 5 illustrates the device 100 communicatively connected to a plurality of external devices through the network 240. In the illustrated embodiment, device 100 is connected to one or more additional devices 400, one or more portable devices 405, and a server 410. The one or more additional devices 400 may have a similar construction as device 100. In some embodiments, the one or more additional devices 400 are configured to send and receive information from device 100 and/or server 410. The one or more portable devices 405 may include, a handheld radio, a vehicle radio, a body camera, a display (for example, a head mounted display), a smart telephone, a tablet, and a computer. The server 410 is a computer including, among other things, an electronic processor and memory. The server 410 includes combinations of hardware and software that are operable to, among other things, perform processes or operations described herein.

In operation, the controller 205 and/or server 410 receive one or more characteristics related to the device 100, the target 110, an area surrounding the device 100, and/or an area surrounding the target 110. The controller 205 and/or server 410 analyze the one or more received characteristics and control the device 100 based on the analyzed characteristics. In one embodiment, the one or more characteristics are analyzed using fuzzy logic. In another embodiment, the one or more characteristics are analyzed using one or more algorithms. In yet another embodiment, the one or more characteristics are analyzed using one or more flowcharts.

Figure 6:
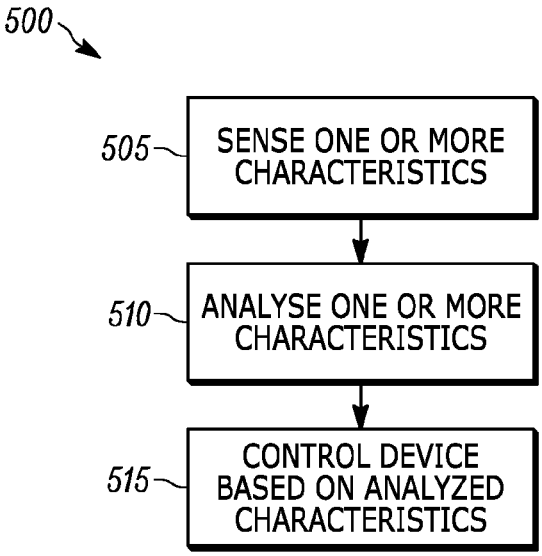
FIG. 6 is a flowchart of an operation of the device of FIG. 1 according to some embodiments.

FIG. 6 is a flowchart illustrating an exemplary method 500 for controlling the device 100. It should be understood that the order of the steps disclosed in operation 500 could vary. Additional steps may also be added to the control sequence and not all of the steps may be required. Additionally, the method 500 may be performed using the controller 205 and/or the server 410. The one or more sensors 215 sense one or more characteristics (block 505). The sensed characteristics are received and analyzed (block 510). The device 100 is then controlled based on the analyzed characteristics (block 515).

The device 100 may be controlled by allowing or prohibiting the projection of the one or more electrodes 105 and by controlling a predetermined power (based on the analyzed characteristics) provided to the one or more electrodes 105 after projection. In some embodiments, the predetermined power may be controlled by allowing output for a predetermined time period (based on the analyzed characteristics). In some embodiments, the predetermined power may be determined by determining a change of power $P_{Change}$ from a baseline power $P_B$. A change of power $P_{Change}$ may be determined by Equation 1 below, wherein $P_N$ is a new power.

$$P_{Change} = \frac{P_N}{P_B} \quad \text{[Equation 1]}$$

In some embodiments, the baseline power $P_B$ is a predetermined power that the device 100 is initially set at. In other embodiments, the baseline power $P_B$ may be recalculated in response to changed conditions (for example, when parameters (such as weight, age, etc.) change after each ejection of the one or more electrodes 105 and/or after each use of the device 100). For example, in some embodiments, after an ejection, the target 110 may change. In such an embodiment, the baseline power PB may then change in response. However in other embodiment, after an ejection, the target 110 may not change. In such an embodiment, the baseline power $P_B$ may not change. In some embodiment, the baseline power $P_B$ is determined using median characteristics of a target. In some embodiments, the baseline power may be determined using Equation 1 below.

$$P_B = \frac{W_B * W_F + A_B * A_F + Para_{1B} * F_1 + \ldots + Para_{nB} * F_n}{W_F + A_F + F_1 + F_n} \quad \text{[Equation 2]}$$

Wherein, $W_B$ is a baseline weight, $W_F$ is a weight factor, $A_B$ is a baseline age, $A_F$ is a age factor, $Para_{1B}$ is a first baseline parameter, $F_1$ is a first factor, $Para_{nB}$ is a n number baseline parameter, and $F_n$ is a n number factor.

In some embodiments, the new power $P_N$ may be determined using Equation 3 below.

$$P_N = \frac{W_N * W_F + A_N * A_F + Para_{1N} * F_1 + \ldots + Para_{nN} * F_n}{W_F + A_F + F_1 + F_n} \quad \text{[Equation 3]}$$

Wherein, $W_N$ is a new weight determined by characteristics sensed by the one or more sensors 215, $A_N$ is a new age determined by characteristics sensed by the one or more sensors 215, $Para_{1N}$ is a first new parameter determined by characteristics sensed by the one or more sensors 215, and $Para_{nN}$ is an n number parameter determined by characteristics sensed by the one or more sensors 215. The first new parameter $Para_{1N}$ and the n number parameter $Para_{nN}$ may be any of the characteristics of the device 100, the target 110, an area surrounding the device 100, and/or an area surrounding the target 110, discussed above, that are sensed by the one or more sensors 215.

Figure 7:
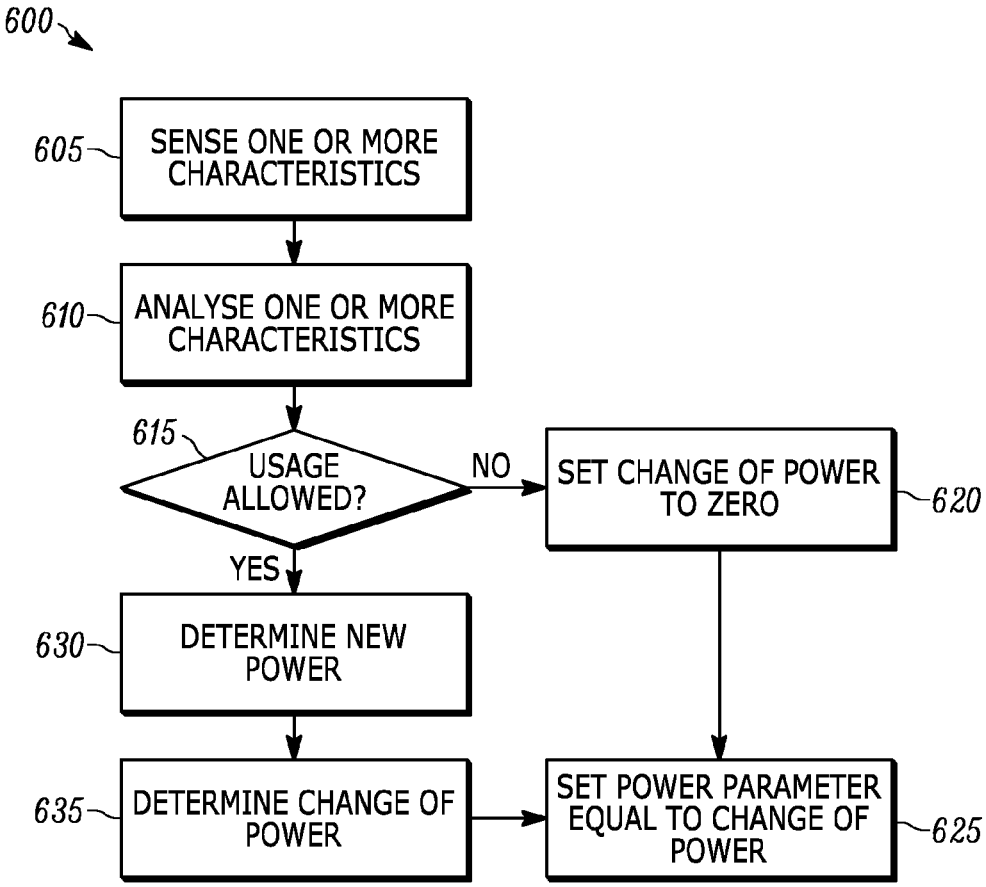
FIG. 7 is a flowchart of an operation of the device of FIG. 1 according to some embodiments.

FIG. 7 is a flowchart illustrating an exemplary method 600 for controlling the device 100. It should be understood that the order of the steps disclosed in operation 600 could vary. Additional steps may also be added to the control sequence and not all of the steps may be required. Additionally, the method 600 may be performed using the controller 205 and/or the server 410. The one or more sensors 215 sense one or more characteristics (block 605). The sensed characteristics are received and analyzed (block 610). In block 615, a determination is made whether usage of the device 100 is allowed. In some embodiments, usage of the device 100 may not be allowed based on the analysis of the one or characteristics. For example, after analyzing the one or more characteristics, it may be determined that target 110 is incapacitated, or otherwise unable to receive electrical current from device 100, and usage of the device 100 is not allowed.

If usage is not allowed, the change of power $P_{Change}$ is set to zero (block 620). A power parameter of the device 100 (for example, the amount of power provided to the electrodes 105 if projected) is then set equal to the change of power $P_{Change}$ (block 625). If usage is allowed, a new power $P_N$ is determined (block 630). In some embodiments, the new power $P_N$ may be determined based on the sensed characteristics of block 605. Additionally, as discussed above, in some embodiments, the new power $P_N$ is determined based on Equation 3. The change of power $P_{Change}$ is then determined (block 635). As discussed above, in some embodiments, the change of power $P_{Change}$ is determined using Equation 1. The power parameter is then set equal to the change of power $P_{Change}$ (block 625). In seine embodiments, once the power parameter is set, the power parameter may be a power output by the one or more electrodes 105. For example, the power parameter may be output to other devices 400, portable device 405, and/or the server 410. Additionally, in some embodiments, an alert that the one or more electrodes 105 have been projected may be output to other devices 400, portable device 405, and/or the server 410.

in some embodiments, the one or more characteristics are continuously received and analyzed after projection of the one or more electrodes 105. In such an embodiment, the device 100 may be continuously controlled based on the analyzed characteristics. For example, after projection of the electrodes 105, the heartrate of the target 110 may be continuously monitored. Based on the monitored heartrate of the target 110, the device 100 and/or server 410 may control the power provided to the electrodes 105.

In some embodiments, the device 100 is configured to provide one or more alerts to the user via the user-interface 220. In such an embodiments, the one or more alerts may correspond to the control the of the one or more electrodes 105 (for example, indication of why projection of the one or more electrodes 105 is prohibited, indication of an increase and/or reduction of power provided to the one or more electrodes 105, etc.).

In the foregoing specification, specific embodiments have been described. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment may be implemented as a computer-readable storage medium having computer readable code stored thereon for programming a computer (for example, comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it may be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. A conducted electrical device comprising:

a housing;

an electrode configured to be projected from the housing;

a sensor configured to sense a characteristic of a target; and a controller configured to receive, prior to projection of the electrode, the characteristic as a function of at least one selected from the group consisting of audio and video, corresponding to a target, and control the electrode based on the characteristic.

2. The device of claim 1, further comprising a communication interface configured to receive a second characteristic of the target from at least one selected from a group consisting of a second conducted electrical device, a portable device, and a server.

3. The device of claim 2, wherein the controller is further configured to control the electrode based on the second characteristic.

4. The device of claim 1, wherein the controller controls the electrode by varying a power output by the electrode.

5. The device of claim 1, wherein the controller controls the electrode by controlling the projection of the electrode from the housing.

6. The device of claim 1, wherein the controller controls the electrode by prohibiting the projection of the electrode from the housing.

7. The device of claim 1, further comprising a second sensor, wherein the second sensor is at least one selected from the group consisting of an explosive device sensor and a heartbeat sensor.

8. The device of claim 1, wherein the controller further controls the electrode based on a second sensed characteristic received from the second sensor.

9. A method of controlling a conducted electrical device that includes a housing and an electrode configured to be projected from the housing, the method comprising:

sensing, via a sensor, a characteristic of a target;

receiving, prior to projection of the electrode and via the sensor, the characteristic of the target, wherein the sensor is at least one selected from the group consisting of an audio sensor and a video sensor; and controlling, via a controller, the electrode based on the characteristic.

10. The method of claim 9, further comprising receiving, via a communication interface, a second characteristic of the target from at least one selected from a group consisting of a second conducted electrical device, a portable device, and a server.

11. The method of claim 10, further comprising controlling, via the controller, the electrode based on the second characteristic.

12. The method of claim 10, wherein controlling the electrode based on the characteristic includes varying a power output by the electrode.

13. The method of claim 10, wherein controlling the electrode based on the characteristic includes controlling a projection of the electrode from the housing.

14. The method of claim 10, wherein controlling the electrode based on the characteristic includes prohibiting a projection of the electrode from the housing.

15. The method of claim 10, wherein the step of controlling the electrode based on the characteristic includes:

determining, based on the characteristic, a change of power from a baseline power, setting a power parameter equal to the change of power, and outputting an output power having the power parameter, via the one or more electrodes.

16. The method of claim 15, wherein the change of power is determined based on one or more selected from the group consisting of a weight of the target, an age of the target, a sex of the target, a health of the target, a condition of the target, of a condition of an area around the target, and a condition of the device.

17. The method of claim 15, wherein the change of power is set approximately to zero when projection of the electrode from the housing is prohibited.

18. The method of claim 10, further comprising sensing, via a second sensor, a second characteristic of the target.

19. The method of claim 18, wherein sensing via a second sensor includes sensing from at least one sensor selected from the group consisting of an explosive device sensor and a heartbeat sensor.

20. The method of claim 18, further comprising controlling, via the controller, the electrode based on the second characteristic.

21. A system comprising:

a first device; and a second device separate from the first device, the second device including a housing, an electrode configured to be projected from the housing, and a controller configured to receive, from the first device prior to projection of the electrode, a characteristic as a function of at least one selected from the group consisting of audio and video, corresponding to a target, and control the electrode based on the characteristic.

22. The system of claim 21, wherein the first device includes a second housing, a second electrode configured to be projected from the second housing, and a second controller configured to receive, from the second device, a second characteristic, and control the second electrode based on the second characteristic.

23. The system of claim 22, wherein the first device is at least one selected from the group consisting of a handheld radio, a vehicle radio, a body camera, a display, a smart telephone, a tablet, and a computer.

24. The system of claim 21, wherein the first device further comprises a sensor configured to sense the characteristic of the target.

* * * * *